US006349810B1

(12) United States Patent
I-Chia

(10) Patent No.: US 6,349,810 B1
(45) Date of Patent: Feb. 26, 2002

(54) SECURITY UNIT FOR A PAPER CURRENCY RECEIVING SYSTEM FOR VENDING MACHINE OR THE LIKE

(75) Inventor: Lin I-Chia, Taipei (TW)

(73) Assignee: Gamemax Corporation, Taipei (TW)

( * ) Notice: Subject to any disclaimer, the term of this patent is extended or adjusted under 35 U.S.C. 154(b) by 0 days.

(21) Appl. No.: 09/577,618

(22) Filed: May 25, 2000

(51) Int. Cl.[7] ..... G07D 7/00
(52) U.S. Cl. ..... 194/203
(58) Field of Search ..... 194/203, 206, 194/350, 351

(56) References Cited

U.S. PATENT DOCUMENTS 5,494,144 A * 2/1996 Izawa ..... 194/203

* cited by examiner

*Primary Examiner*—Christopher P. Ellis
*Assistant Examiner*—Mark J Beauchaine
(74) *Attorney, Agent, or Firm*—Robert E. Bushness, Esq.

(57) ABSTRACT

A security unit installed in a paper currency receiving system in a vending machine at a rear side of a paper currency passage to stop recognized paper currency from being pulled backwards with an external object, the security unit including a holder block having staggered rows of forward protruding plates, a cover plate swinging between a first position where the cover plate is closed with openings thereof coupled to the forward protruding plates to stop recognized paper currency from being pulled backwards, and a second position where the cover plate is disengaged from the forward protruding plates for enabling inserted paper currency to pass.

4 Claims, 6 Drawing Sheets

SECURITY UNIT FOR A PAPER CURRENCY RECEIVING SYSTEM FOR VENDING MACHINE OR THE LIKE

BACKGROUND OF THE INVENTION

The present invention relates to a paper currency receiving system for a vending machine or the like, and more particularly to a security unit for a paper currency receiving system which prevents inserted paper currency from being pulled backward after its recognition.

FIG. 9 shows a paper currency receiving system for use in a vending machine or the like according to the prior art. This structure of paper currency receiving system comprises a housing A, a paper currency insertion slot A1 at one side of the housing A, a paper currency outlet A2 at an opposite side of the housing A, a paper currency recognition control circuit board B and a transmission mechanism C installed in the housing A, and a toothed plate D disposed in the paper currency outlet A2 to stop recognized paper currency from being pulled backwards with an external object. This structure of paper currency receiving system is still not satisfactory in function because the toothed plate D cannot effectively stop recognized paper currency from being pulled out of the system with an external object.

SUMMARY OF THE INVENTION

The present invention has been accomplished to provide a security unit for a paper currency receiving system used in a vending machine or the like, which effectively stops recognized paper currency from being pulled backwards with an external object. According to the present invention, the a casing, a holder fixedly mounted inside the casing, the holder comprising staggered rows of forward protruding plates, an axle transversely mounted in the casing, a cover plate fastened to the axle and turned with the axle between a first position where the cover plate is closed on the holder to stop paper currency from passing in and out and an open position where the cover plate is opened from the holder for letting inserted paper currency to pass, the cover plate having staggered rows of openings, which receive the forward protruding plates of the holder when the cover plate is moved to the first position, an actuating member pivoted to the axle and turned about the axle to lift the cover plate.

DETAILED DESCRIPTION OF THE PREFERRED EMBODIMENT

Figure 1:
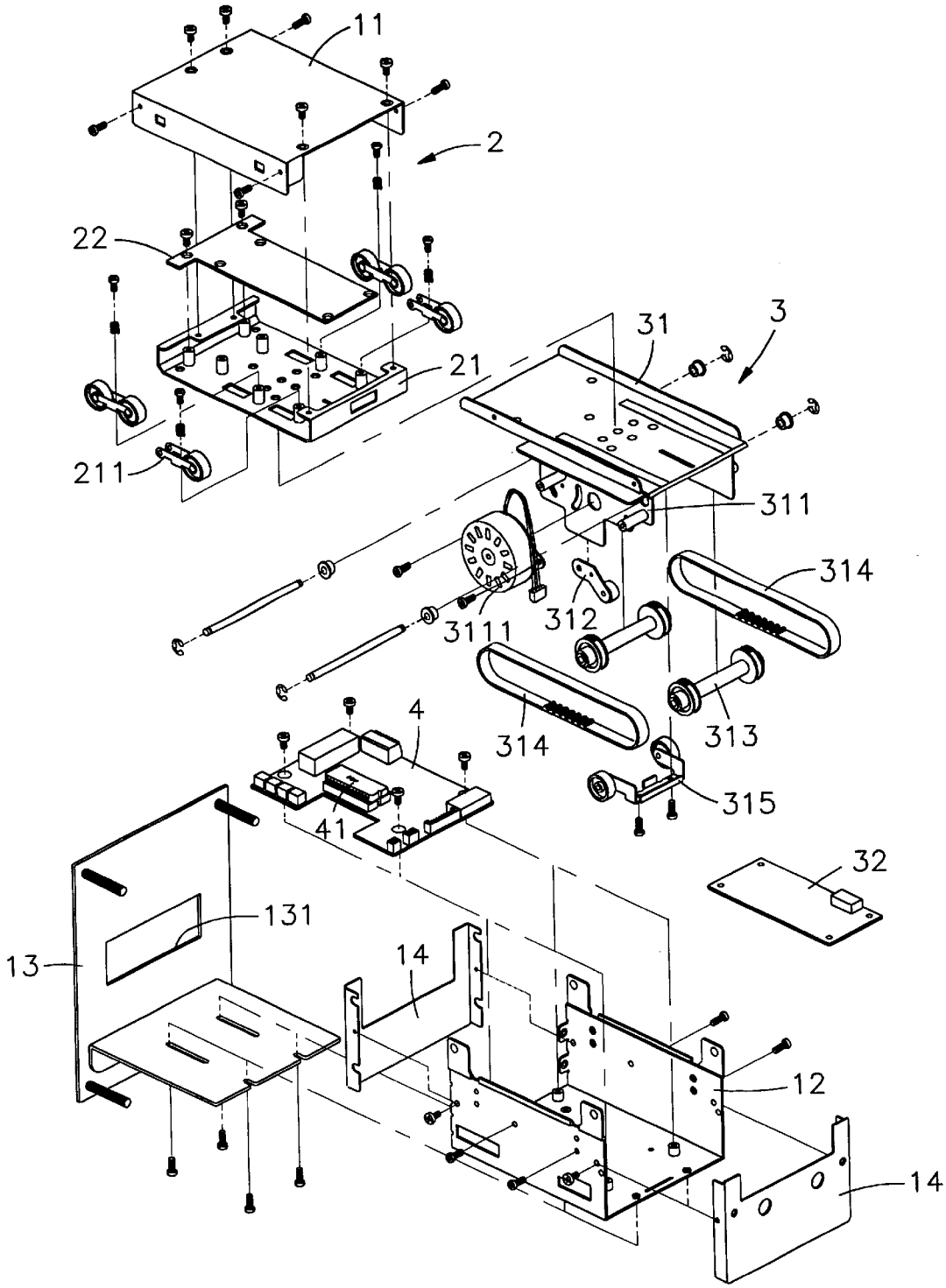
FIG. 1 is an exploded view of a paper currency receiving system constructed according to the present invention.
Figure 2:
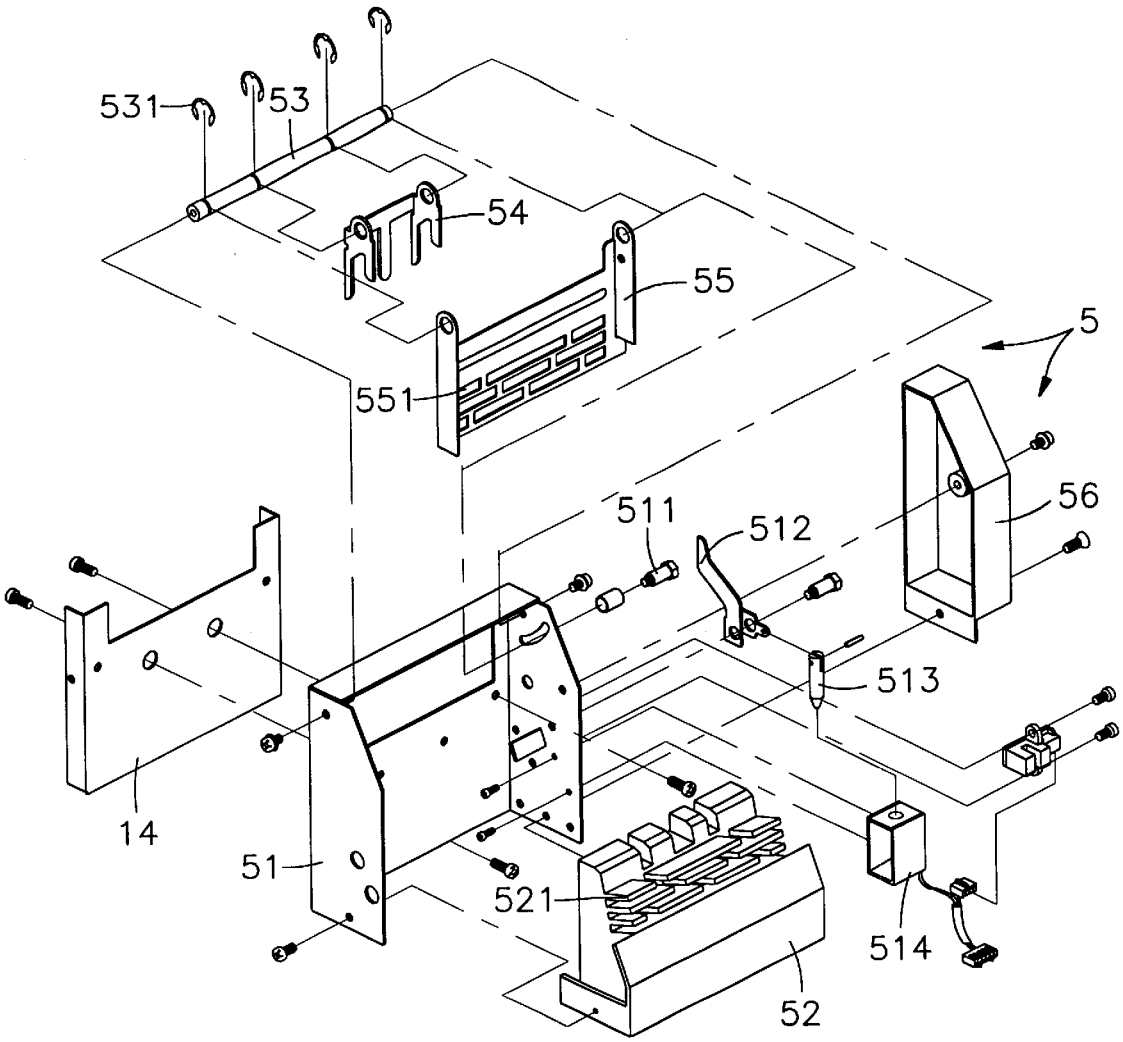
FIG. 2 is an exploded view of a security unit for use with the paper currency receiving system shown in FIG. 1 according to the present invention.
Figure 3:
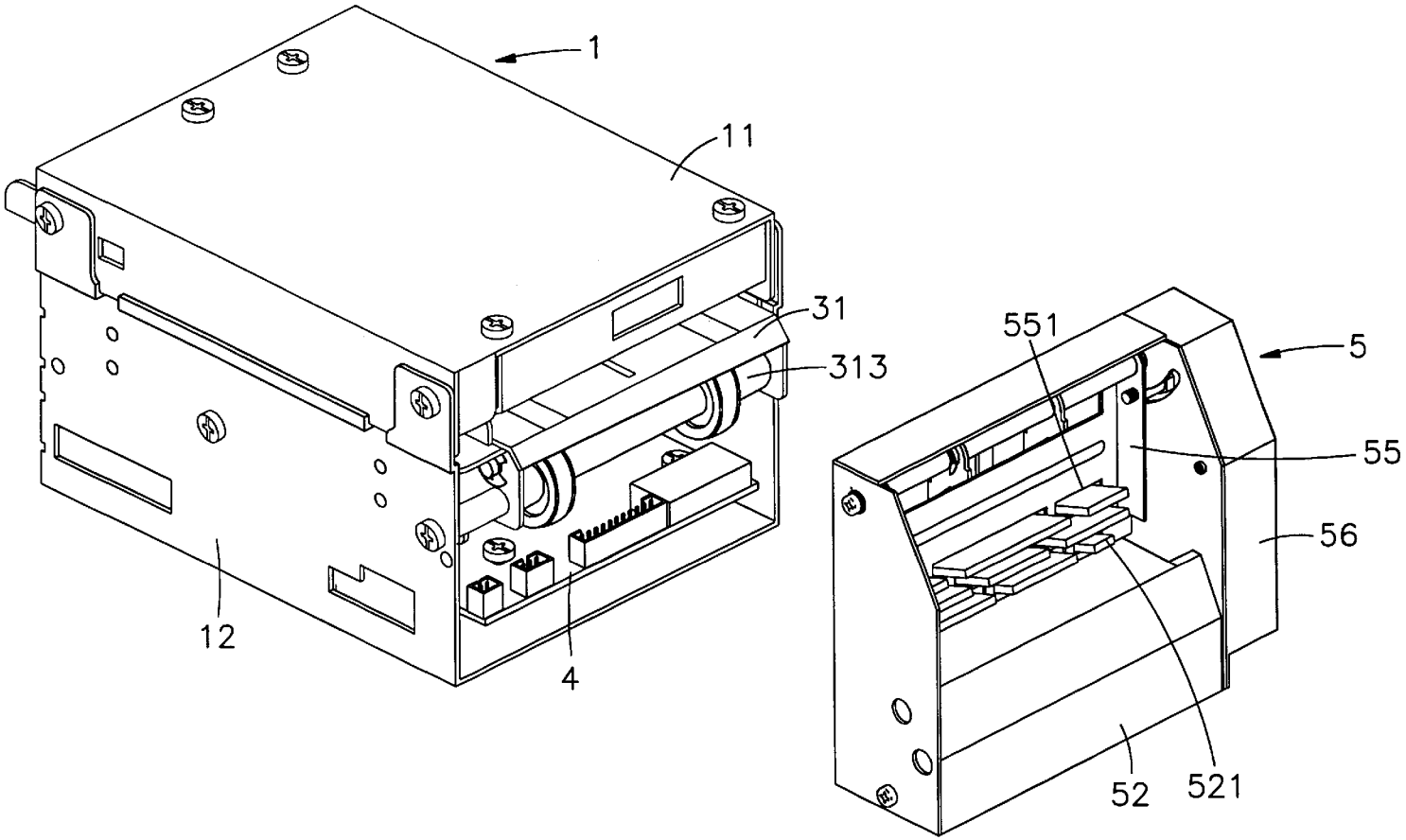
FIG. 3 is perspective view of the paper currency receiving system shown in FIG. 1 and the security unit shown in FIG. 2.
Figure 4:
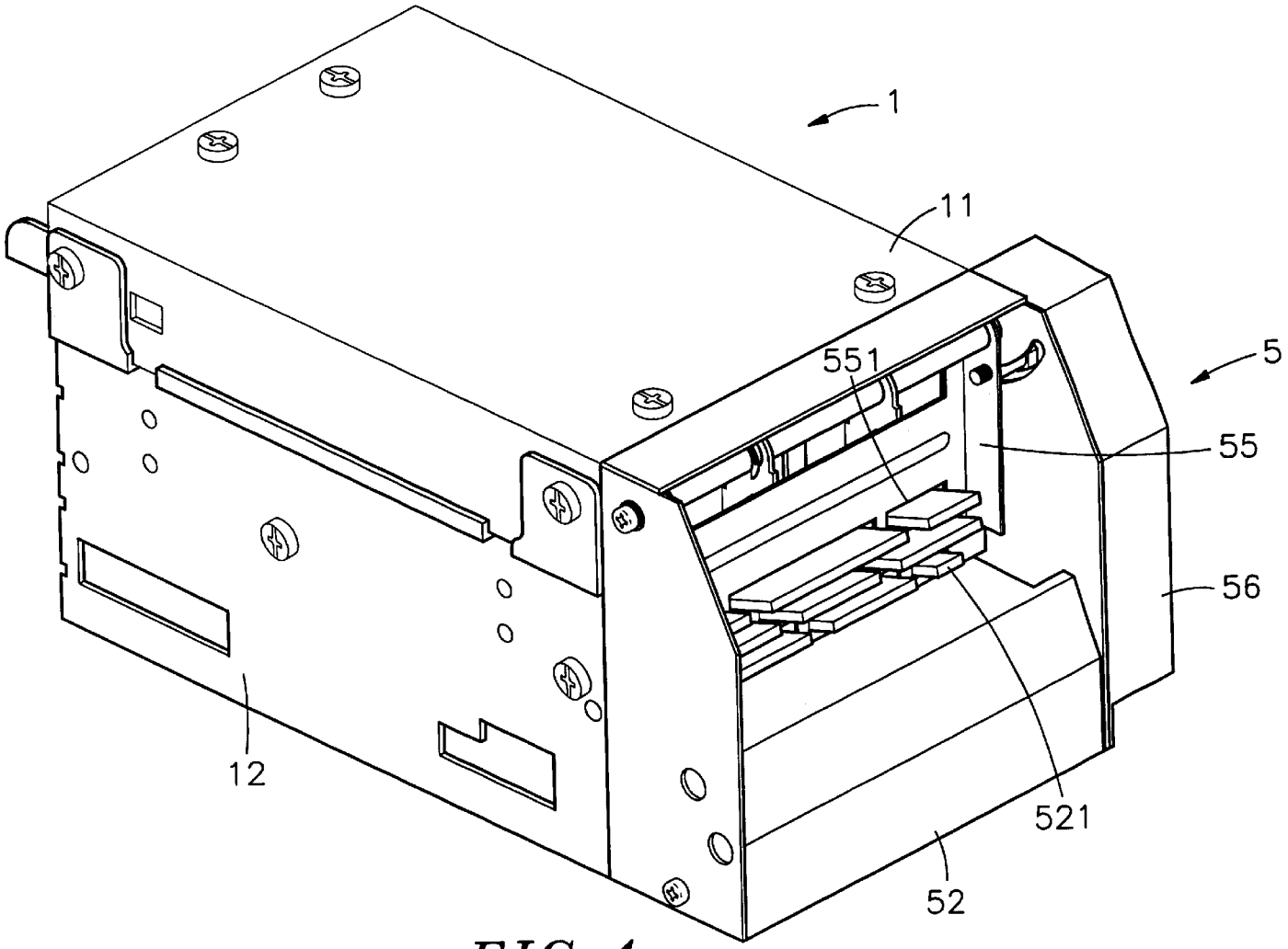
FIG. 4 is perspective view showing the security unit fastened to the paper currency receiving system according to the present invention.
Figure 8:
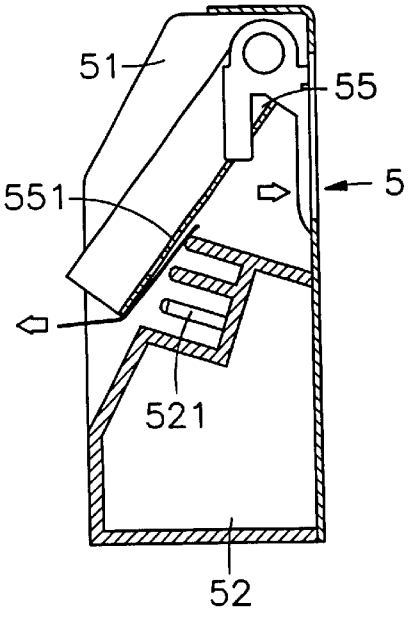
FIG. 8 illustrates the operation of the security unit upon entering of paper currency (Step IV).
Figure 7:
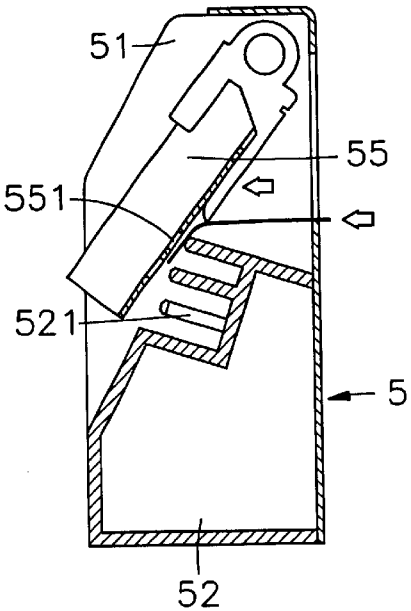
FIG. 7 illustrates the operation of the security unit upon entering of paper currency (Step III).
Figure 6:
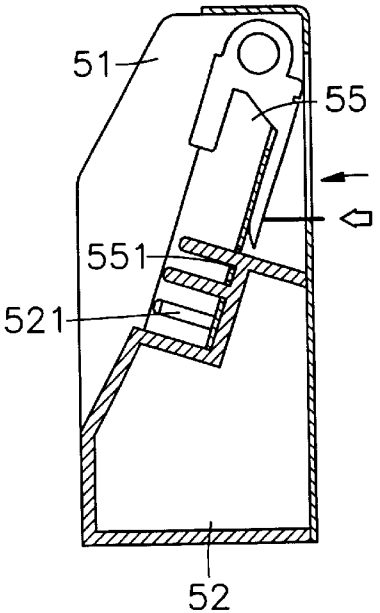
FIG. 6 illustrates the operation of the security unit upon entering of paper currency (Step II).
Figure 5:
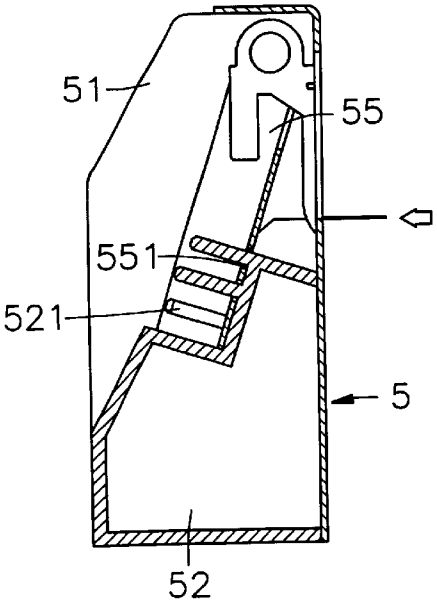
FIG. 5 illustrates the operation of the security unit upon entering of paper currency (Step I).
Figure 9:
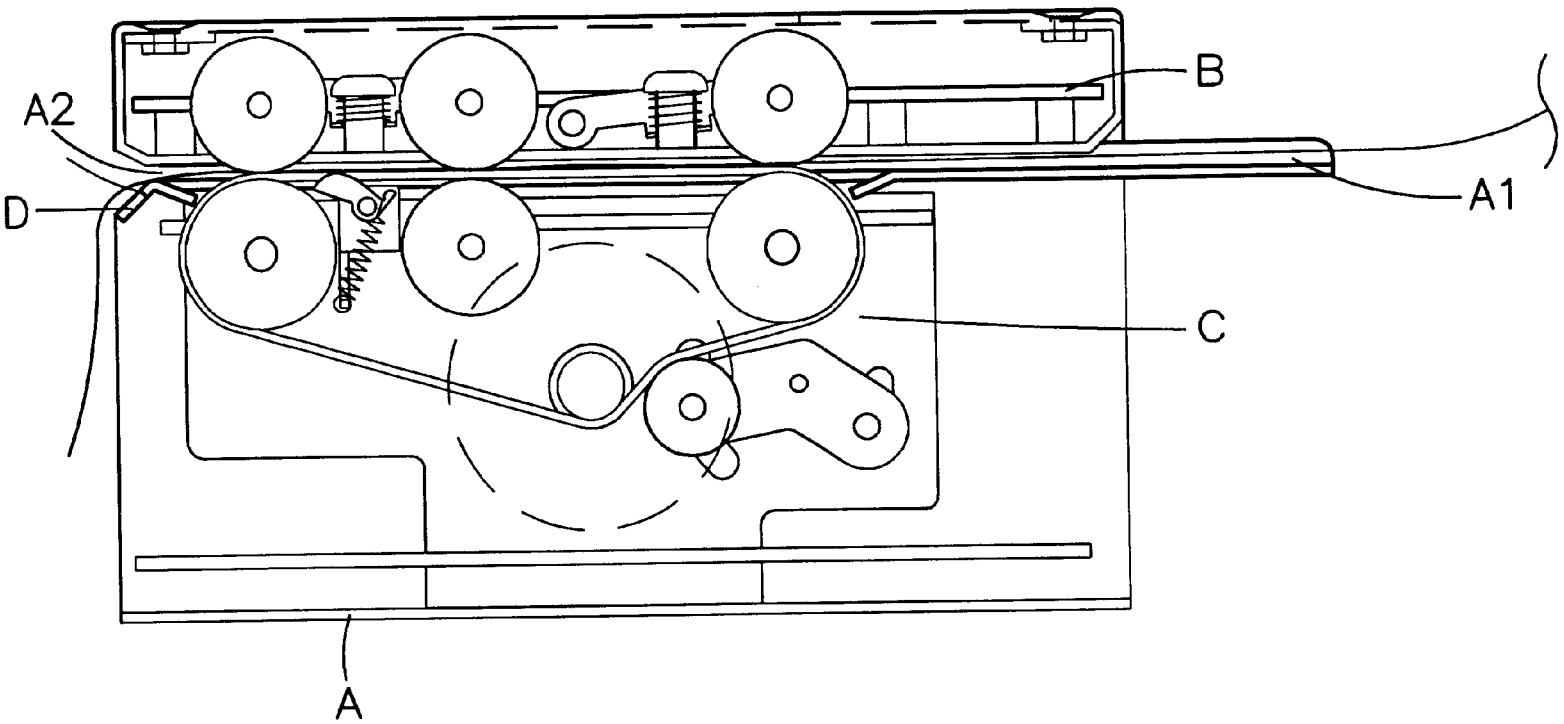
PRIOR ART FIG. 9
FIG. 9 is a sectional view of a paper currency receiving system according to the prior art.

Referring to FIGS. from 1 through 4, a paper currency receiving system in accordance with the present invention comprises a housing 1, a paper currency recognition unit 2, a paper currency pick-up unit 3, a control circuit board 4, and a security unit 5. The housing 1 is comprised of a top cover shell 11, a base frame 12, a front panel 13, front and rear cover plates 14. The paper currency recognition unit 2, the paper currency pick-up unit 3 and the control circuit board 4 are installed in the housing 1. The security unit 5 is covered on one side of the housing 1 opposite to the front panel 13 and coupled to the output side of the paper currency pick-up unit 3. The front panel 13 has an insertion slot 131 through which paper current is inserted.

The paper currency recognition unit 2 comprises a holder base 21, a transmitter module 22 fixedly mounted on the holder base 21, pairs of pulleys 211 provided at two opposite lateral sides of the transmitter module 22 and protruding over the bottom side wall of the holder base 21 through respective openings on the holder base 21.

The paper currency pick-up unit 3 comprises a track 31 for guiding in inserted paper currency, a receiver module 32, a rack 311 fixedly provided at the bottom side of the track 31, a motor 3111 mounted on the rack 311 at one side, two wheel assemblies 313 mounted in the rack 311 and rotated by the motor 3111, two transmission belts 314 bilaterally coupled between the wheel assemblies 313 and disposed in contact with the pulleys 211, a guide roller assembly 315 installed in the rack 311 to guide rotary motion of the transmission belts 314, and an adjustable tension guide 312 adjusted to control the tension of the transmission belts 314.

The security unit 5 is fixedly fastened to the rear cover plate 14 of the housing 1, comprised of a casing 51, a holder 52 fixedly mounted inside the casing 51, an axle 53 transversely mounted in the casing 51 near the top side, a cover plate 55 fastened to the axle 53, an actuating member 54 respectively pivoted to the axle 53 and turned about the axle 53 to turn the cover plate 55 upwards, the actuating member having a plurality of pawls for moving the cover plate 55, a plurality of C-shaped clamps 531 respectively fastened to the axle 53 to secure the actuating member 54 in place, a stop bolt 511 inserted through a sliding slot on one lateral side wall of the casing 51 and fixedly fastened to the cover plate 55, a crank 512 pivoted to the casing 51 at one lateral side and stopped with its one end at the stop bolt 511, an inductor 514 mounted outside the casing 51 adjacent to the crank 512, a rod member 513 connected to one end of the crank 512 and inserted into the inductor 514, and a side cover shell 56 covered on one lateral side wall of the casing 51 over the inductor 514, the rod member 513, the crank 512 and the stop bolt 511. The holder 52 comprises staggered rows of forward protruding plates 521 respectively inserted through respective through holes 551 on the cover plate 55.

The control circuit board 4 controls the operation of the transmitter module 22 and the receiver module 32, comprising a CPU 41. The CPU 41 receives and analyzes signal received from the transmitter module 22 through the receiver module 32, and judges the authenticity of inserted paper currency and its value, and then turns the motor 3111 forwards or backwards, enabling inserted paper currency to be received or rejected.

Referring to FIGS. from 5 through 8, when paper currency is inserted through the insertion slot 131 on the front panel 13 into the track 31 of the paper currency pick-up unit 3, and at the same time the control circuit board 4 is triggered to turn on the transmitter module 22 and the receiver module 32. If inserted paper all currency is authentic, the control circuit board 4 turns the motor 3111 in one direction, enabling inserted paper currency to be carried forwards. On the contrary, if inserted paper currency is a counterfeit, the control circuit board 4 turns the motor 3111 in the reversed direction, enabling inserted paper currency to be moved backward and rejected.

When recognized, inserted paper currency is delivered through the track 31 to the security unit 5. When inserted paper currency is continuously moved forwards after entering the security unit 5, it touches the actuating member 54, causing the cover plate 55 to be turned upwards and opened for enabling inserted paper currency to fall to the paper currency collector (not shown). In case the inserted paper currency is pulled backwards by a cord, a tape, a steel wire, or any of a variety of external object, the accepted paper currency will be stopped from backward movement by the forward protruding plates 521, which are inserted through the through holes 551 on the cover plate 55 at this time.

While only one embodiment of the present invention has been shown and described, it will be understood that various modifications and changes could be made thereunto without departing from the spirit and scope of the invention disclosed.

What the invention claimed is:

1. A security unit installed in a paper currency receiving system at a rear side of a paper currency passage to stop inserted paper currency from being pulled backwards by an external object, the security unit comprising a casing, a holder fixedly mounted inside said casing, said holder comprising staggered rows of forward protruding plates, an axle transversely mounted in said casing, a cover plate fastened to said axle and turned with said axle between a first position where said cover plate is closed on said holder to stop paper currency from passing in and out and an open position where said cover plate is opened from said holder for letting inserted paper currency to pass, said cover plate having staggered rows of openings, which receive the forward protruding plates of said holder when said cover plate is moved to said first position, an actuating member pivoted to said axle and turned about said axle to lift said cover plate.

2. The security unit of claim 1 further comprising a stop bolt inserted through a sliding slot on one lateral side wall of said casing and fixedly fastened to said cover plate, a crank pivoted to said casing at one lateral side and stopped with one end thereof at said stop bolt to hold said cover plate in said first position, an inductor mounted outside said casing adjacent to said crank, a rod member connected to one end of said crank and inserted into said inductor, and a side cover shell covered on one lateral side wall of said casing over said inductor, said rod member, said crank and said stop bolt.

3. The security unit of claim 1 wherein said actuating member comprises a plurality of downwardly extended pawls.

4. The security unit of claim 1 wherein pluralities of C-shaped clamps are respectively fastened to said axle to secure said actuating member in place.

* * * * *